US012722855B1

(12) United States Patent
Pescetti

(10) Patent No.: US 12,722,855 B1
(45) Date of Patent: Sep. 1, 2026

(54) ENVELOPE WITH INTERNAL POCKET

(71) Applicant: Admail West, Inc., Sacramento, CA (US)

(72) Inventor: Kathleen Pescetti, Granite Bay, CA (US)

(73) Assignee: Admail West, Inc., Sacramento, CA (US)

( * ) Notice: Subject to any disclaimer, the term of this patent is extended or adjusted under 35 U.S.C. 154(b) by 103 days.

(21) Appl. No.: 18/405,196

(22) Filed: Jan. 5, 2024

(51) Int. Cl.
*B65D 27/08* (2006.01)
*B65D 27/14* (2006.01)
*B65D 27/34* (2006.01)

(52) U.S. Cl.
CPC ..... *B65D 27/08* (2013.01); *B65D 27/14* (2013.01); *B65D 27/34* (2013.01)

(58) Field of Classification Search
CPC ..... B65D 27/08; B65D 27/14; B65D 27/34
USPC ..... 229/316
See application file for complete search history.

(56) References Cited

U.S. PATENT DOCUMENTS 214,165 A * 4/1879 McCullough ..... B65D 27/08 229/72
598,659 A * 2/1898 Hansen ..... B65D 27/08 229/72
628,152 A * 7/1899 Wolfe ..... B65D 27/00 229/72
779,135 A * 1/1905 Reinhold ..... B65D 27/08 229/80
975,627 A * 11/1910 McCloy ..... B65D 27/08 229/72
2,222,443 A * 11/1940 Rubins ..... B42F 19/00 229/72
3,719,319 A * 3/1973 Schleutermann ..... B65D 27/08 229/72
3,788,540 A * 1/1974 Sammons ..... B65D 75/545 40/6
3,979,051 A * 9/1976 Close ..... B65D 27/08 150/147
5,062,530 A * 11/1991 Mitsuyama ..... B65D 27/08 229/72

(Continued)

OTHER PUBLICATIONS

Polymedco, Inc., screenshots from video entitled "Polymedco OC Auto FIT Collection," showing outer and inner envelope, in use since as accessed at www.polymedco.com on Aug. 11, 2025, along with photographs of the inner envelope in use and deconstructed.

*Primary Examiner* — Peter N Helvey
(74) *Attorney, Agent, or Firm* — Heisler & Associates

(57) ABSTRACT

A pocket is located within an inner envelope, with the pocket strategically located to keep bulky items within the pocket from being located within an automated handling region of an outer envelope that contains the inner envelope. The pocket is spaced far enough from a lower edge of the inner envelope that when the inner envelope is upright within the outer envelope, the pocket is above the automated handling region of the outer envelope at a lower portion of the outer envelope. As one option, the pocket is formed by folding an interior flap of the inner envelope against a rear panel thereof and bonding it to the rear panel. Bulky items such as medical sample vials, can be mailed out to users according to a method of this invention with automated envelope handling facilitated by the bulky items kept away from the automated handling region of the outer envelope.

8 Claims, 4 Drawing Sheets

(56) References Cited

U.S. PATENT DOCUMENTS

| | | | | |
|---|---|---|---|---|
| 5,318,222 | A * | 6/1994 | Bartlett | B42F 7/02<br>229/72 |
| 5,875,957 | A * | 3/1999 | Yocum | B65D 5/48024<br>229/72 |
| 2003/0230626 | A1* | 12/2003 | Rones | B65D 27/34<br>229/72 |
| 2005/0173500 | A1* | 8/2005 | Kranz | B65D 31/12<br>229/72 |
| 2011/0101082 | A1* | 5/2011 | Zandman | B65D 27/38<br>229/310 |

* cited by examiner

ENVELOPE WITH INTERNAL POCKET

FIELD OF THE INVENTION

The following invention relates to mailing envelopes. More particularly, this invention relates to mailing envelopes which are configured to be flat enough to be handled by automated equipment which is configured to handle flat envelopes, and envelopes which are mostly flat, but configured to contain moderately bulky items therein, such as medical sample containing vials.

BACKGROUND OF THE INVENTION

Envelopes for use in the mail come in a variety of different shapes and sizes. Generally, envelopes have a front surface opposite a rear surface which surfaces are generally planar and parallel with each other, but which can bulge outwardly somewhat. A perimeter of these surfaces include a common lower edge, side edges and an upper edge. Typically, the upper edge or at least one of the side edges is configured to be openable and closable to allow for accessing an interior of the envelope. An address space is provided on the front surface to indicate an address for the envelope and its contents when routed through the mail. Postage is also typically provided on this front surface. A return address space can also be provided on the front surface or optionally on the rear surface, to identify the sender of the envelope and its contents.

Processing of envelopes through the mail for efficient delivery thereof involves multiple separate processes and often includes handling of the envelopes by automated machinery. Often such automated machinery is configured to convey the envelopes while oriented upright, and with a lower edge of the envelope below other portions of the envelope being carried within a slot or groove of the automated machinery. Friction wheels or belts (or other force applying equipment) causes the envelopes to move along such a slot or groove during processing.

Conveyance of the envelope allows the envelope to pass by scanners which can automatically read addressing information. The machinery can then transport the envelope to a desired location, such as to a container were similarly addressed envelopes are destined, or to a vehicle for further transport to a general area which includes the address of the envelope therein. When envelopes are sufficiently thin and appropriately sized and shaped, they can be transported and processed by such automated handling equipment without difficulty. Because the simplicity of handling such conforming envelopes is increased, opportunities exist for delivery businesses and/or official mail processors to offer discounts to senders of such conforming envelopes.

One problem encountered by automated envelope handling equipment is that envelopes can become jammed in such equipment when dimensions of the envelopes fall outside of required ranges. While envelopes can fall outside of required ranges in many different ways, one difficult to control dimension of an envelope is its thickness between front and rear panels thereof. While an envelope can be constructed to be generally planar and only as big as a thickness of the front and rear panels themselves, when the envelope has contents therein these panels will tend to bulge outwardly to accommodate the thickness of the contents.

Because envelope handling equipment often grips, moves and guides the envelopes by handling only lower portions of the envelopes, it is these lower portions of the envelopes which need to be sufficiently thin to avoid becoming jammed or otherwise mishandled by the envelope processing equipment. As one example, some envelope handling equipment engages with a portion of each envelope extending about four inches up from the bottom of the envelope, defining a "readable area" on the envelope. While some thickness beyond a minor thickness of the front panel and rear panel can be accommodated within these lower four inches or other readable area on the envelope, there are limits to such allowable thickness which are dictated by the machinery itself. If an excessively bulky item needs to be contained within the envelope, such an excessively bulky item cannot be located within such a "readable area" or other lower portion of the envelope, without risk of jamming equipment or other mis-processing. However, if an excessively bulky item is contained within the envelope but outside of this "readable area," a potential for reliable effective automated handling of such a bulky envelope could potentially be accommodated, as is the thesis upon which this invention is based.

Significant benefits to society are often provided by being able to efficiently and effectively transport items of moderate bulkiness within envelopes that can be processed through regular mail or other low cost delivery services. For instance, some medical tests can potentially be cost effectively performed by individuals at home, and then medical samples can be mailed into a laboratory or other facility for testing or other processing. Examples of such at home medical tests can include tests such as an "Occult Blood Stool Immunoassay." For the benefits of such at home medical tests to be fully realized, the costs associated with outgoing mail, return mail, kit manufacture and laboratory processing of returned kits all need to be minimized.

In the prior art, home medical test kits involving somewhat bulky medical sample vials have caused the envelopes containing such medical sample vials to be too bulky for automated envelope handling machinery. Thus, postal carriers and other delivery services have had to charge additionally (or refuse to provide discounts) for handling envelopes including such medical sample vials. If at least one of the mailing steps for such sample vials, including the outgoing mail or the return mail, could be somehow physically structured to allow for automated handling, a lower cost for such handling could be achieved and the benefits of at home medical tests could be more fully realized. Not only are economic benefits potentially realized, but negative impacts on the environment are provided, such as avoidance of individuals' need to travel to a lab location or sample collecting personnel needing to travel to the patient, thus reducing transportation trips and emissions associated therewith.

Some shippers have a large number of similar envelopes to ship and benefit from reduced shipping rates if these envelopes are pre-sorted into subsets of multiple envelopes which are traveling to related locations (such as to a common ZIP code for instance). However, in some instances the benefits of pre-sorting mail can only be realized if the envelopes can be handled by automated mail processing equipment. However, if the multiple envelopes contain excessively bulky items therein, especially in lower portions of the envelopes, the opportunity for pre-sorting is defeated.

Accordingly, a need exists for an envelope which can contain moderately bulky items, but confine those moderately bulky items to a portion of an envelope sufficiently high (or otherwise beneficially located) on the envelope that operation of automated mail processing equipment is not hampered. One such particular need exists for the shipping of at home medical test kits, including medical sample return vials therein.

SUMMARY OF THE INVENTION

With this invention, an envelope is provided which includes a pocket therein. The pocket is sized to receive a moderately bulky item therein, such as a medical sample return vial. In one embodiment, two envelopes are provided according to a multi-envelope assembly, including an inner envelope and an outer envelope. The inner envelope fits within the outer envelope, and can also be referred to as a return envelope. The pocket is located within the return envelope that is in turn located within the outer envelope.

The pocket is located in a position that is spaced away from a bottom edge (or other edge) of the inner/return envelope, which bottom edge is located closest to a lower edge of the outer envelope. The lower edge of the outer envelope defines that part of the outer envelope which is typically oriented lowest when the outer envelope is being handled by automated envelope handling equipment of a variety which handles envelopes while they are oriented at least somewhat upright. In this way, when the inner envelope is located within the outer envelope, the inner envelope cannot go any lower with the outer envelope than its bottom edge being positioned adjacent to a lower extremity of an interior of the outer envelope. With the pocket of the inner envelope spaced above the bottom edge of the inner envelope, this pocket and any bulky item(s) contained therein, is correspondingly also spaced away from the lower edge of the outer envelope. The outer envelope can then be sufficiently thin within an automated handling region thereof to facilitate automated handling by such machinery.

The inner envelope is generally sized large enough in height and/or width that the pocket within the inner envelope will end up spaced above the lower edge of the outer envelope sufficient to avoid bulky items within the pocket being within the automated handling region on the lower extremity of the outer envelope. In one embodiment, the automated handling region is a lowest four inches of the outer envelope. In one embodiment, this automated handling region is a lower half of the outer envelope. In one embodiment, the inner envelope is at least about half a height of the outer envelope, so that it is not possible (or sufficiently difficult) for the inner envelope to rotate while contained within the outer envelope.

The pocket can be formed in a variety of different ways within the inner envelope. In one embodiment, the inner envelope is formed by folding and bonding with adhesive different portions of the inner envelope to other portions thereof. For instance, the inner envelope can include a front panel parallel with a rear panel and with an interior space therebetween. Side panels can bond the front panel to the rear panel. A top flap can be provided which allows for selective sealing and unsealing of the envelope. An interior flap can be bonded to one of the panels of the inner envelope (such as the rear panel) in a strategic manner, so that upper portions of the interior flap and upper portions of the rear panel can define inner and outer upper edges of the pocket, with an interior of the pocket between the inner flap and the rear panel.

The inner envelope can be formed of a cardboard or other heavy gauge material, such as to provide at least a somewhat waterproof character and/or protection for contents therein. Such protection is provided during initial shipping of the vial or other bulky item contained within the inner envelope when it is shipped open within a sealed outer envelope. When the recipient opens the outer envelope, and then processes a medical sample and places it within the vial or other bulky item and places it back within the inner envelope and seals the inner envelope, the sample return vial is protected during its return shipping process. While it is possible that the inner envelope alone could be handled by automated envelope handling equipment, generally such sample return envelopes are mailed singly by a patient or other user and the benefits of automation, such as bulk mail discount and pre-sorting discount benefits, are unavailable. Thus, a moderately bulky return envelope can be mailed or otherwise delivered without automated processing, without significant detriment. However where possible, one benefit of this invention is the potential for simplified processing during return shipment of the inner/return envelope during return shipping.

OBJECTS OF THE INVENTION

Accordingly, a primary object of the present invention is to provide an envelope with a pocket therein located to support a bulky item away from an automated handling region of the envelope and/or a second outer envelope in which the envelope is located.

Another object of the present invention is to provide a multi-envelope assembly which can support a bulky item at a strategic location which maintains ability for the multi-envelope assembly to be used with automated envelope handling equipment.

Another object of the present invention is to provide a method for efficiently delivering a moderately bulky item, such as a medical sample return vial, from a sender to a recipient.

Another object of the present invention is to provide a method for restricting a bulky item to only portions of an envelope above an automated handling region at the bottom thereof.

Another object of the present invention is to provide an inner envelope sized to be carried within an outer envelope, and with the inner envelope having a pocket for holding a bulky item therein, such as a medical sample return vial, and with the pocket located away from an automated handling region on at least the outer envelope.

Another object of the present invention is to provide a contour of planar flexible envelope forming material that is shaped to be foldable and adhesively bonded to result in an envelope having a pocket spaced away from a lower portion of the envelope.

Another object of the present invention is to provide an envelope with a pocket therein which is wider than it is deep and with the pocket strategically located to keep bulky items contained within the pocket within upper portions of the envelope.

Other further objects of the present invention will become apparent from a careful reading of the included drawing figures, the claims and detailed description of the invention.

DESCRIPTION OF THE PREFERRED EMBODIMENT

Figure 1:
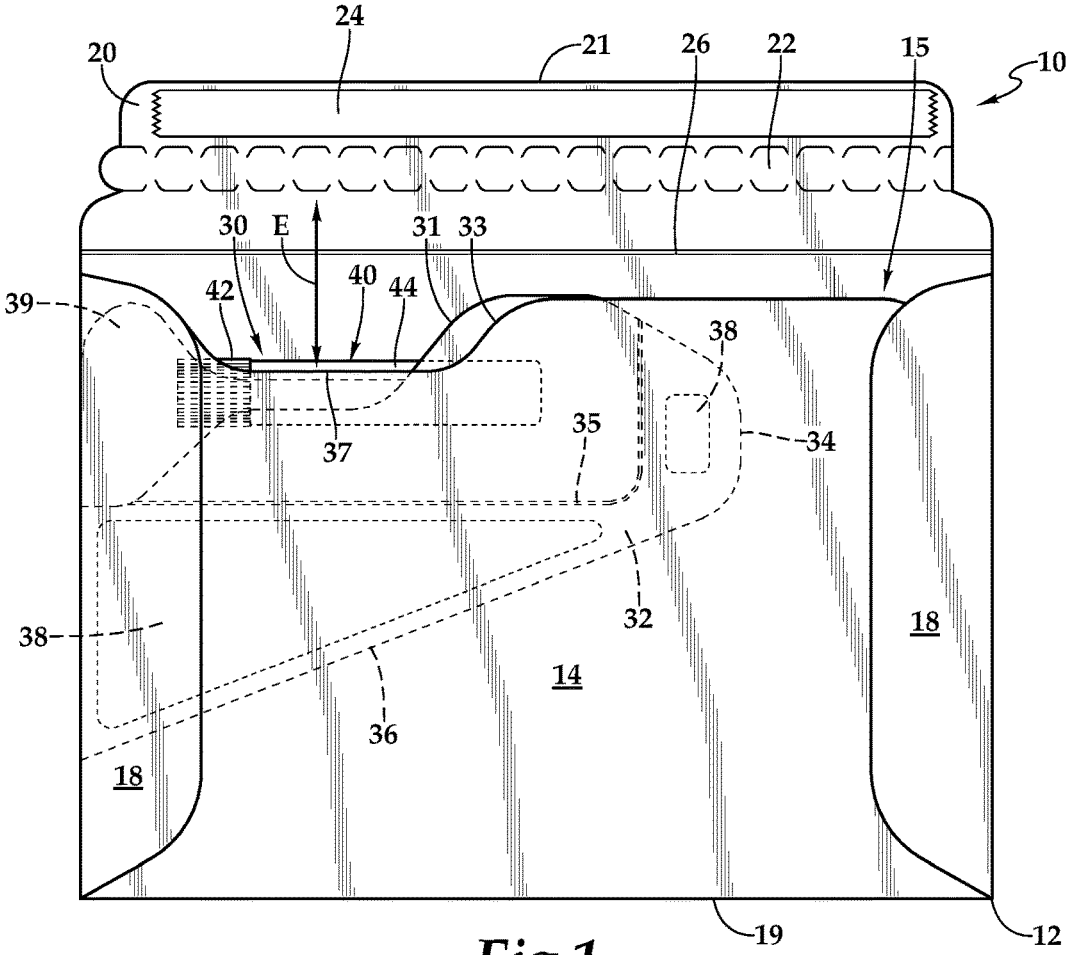
FIG. 1 is a rear elevation view of an envelope with a pocket therein according to one example embodiment of this invention. Structures of the envelope that are hidden within an interior of the envelope are shown in broken lines, and a medical sample return vial illustrative of one form of bulky item, is shown placed within the pocket.
Figure 2:
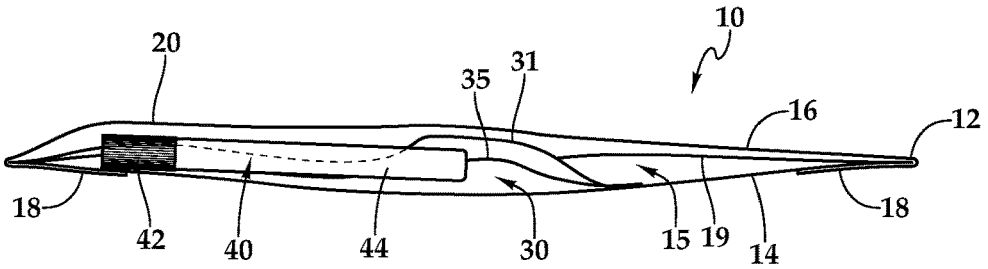
FIG. 2 is a top plan view of that which is shown in FIG. 1.
Figure 3:
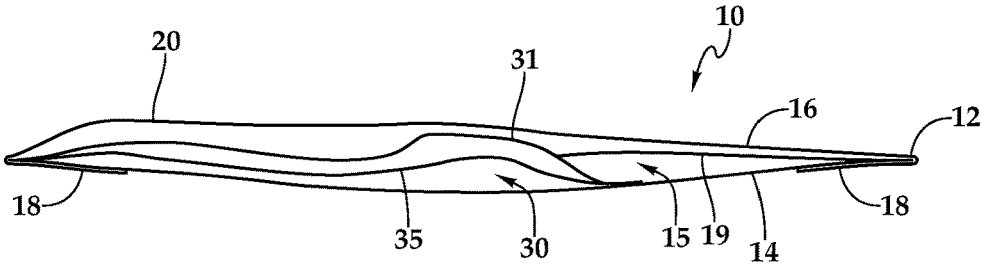
FIG. 3 is a top plan view similar to that which is shown in FIG. 2, but with the medical sample return vial removed.
Figure 5:
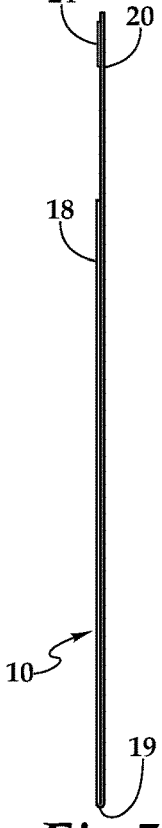
FIG. 5 is a left side elevation view of that which is shown in FIG. 4, and depicting the envelope when empty, a right side elevation view being a mirror image.
Figure 4:
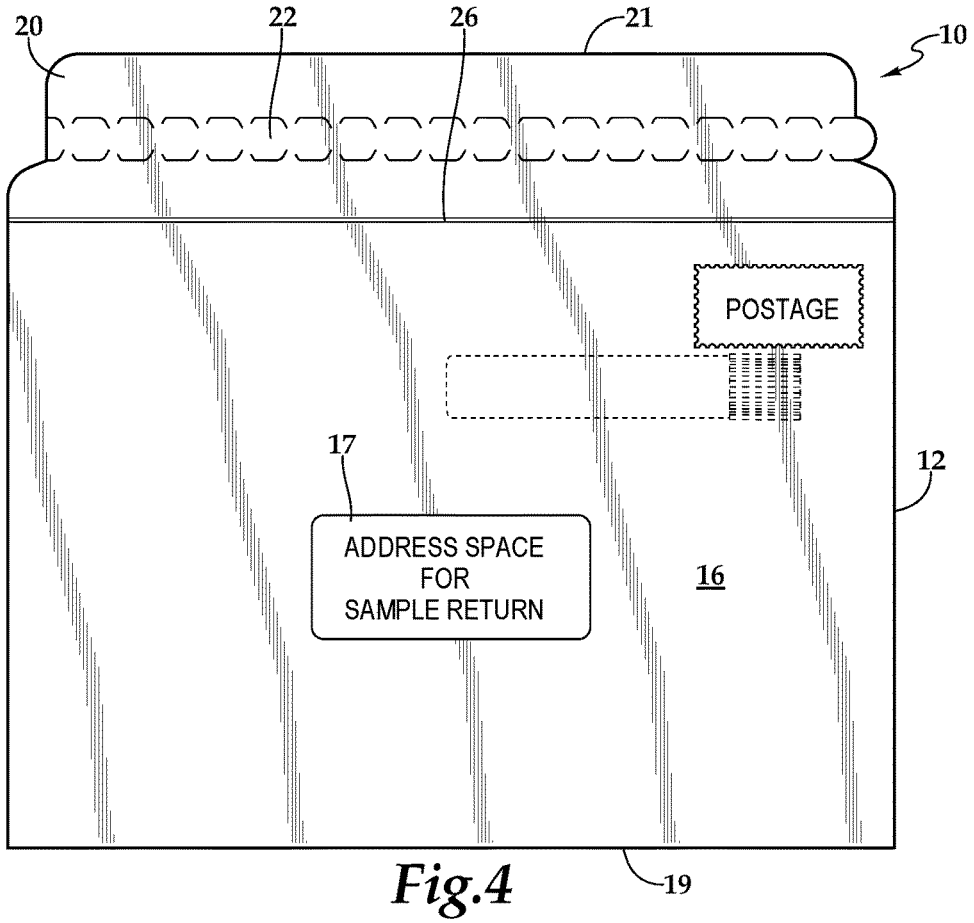
FIG. 4 is a front elevation view of that which is shown in FIG. 1, and with a medical sample return vial having its position within the envelope shown in broken lines.
Figure 6:
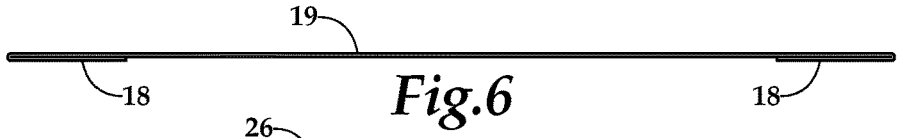
FIG. 6 is a bottom plan view of that which is shown in FIG. 4, and depicting the envelope when empty.

Referring to the drawings, wherein like reference numerals represent like parts throughout the various drawing figures, reference numeral 10 is directed to a return envelope (FIGS. 1-4) which includes a pocket 30 for holding a bulky item such as a sample container 40 therein. The envelope 10 supports the bulky item away from an automated handling region 60 (FIG. 10) of an outer envelope, 50 containing the return envelope 10 and sample container 40 therein.

Figure 7:
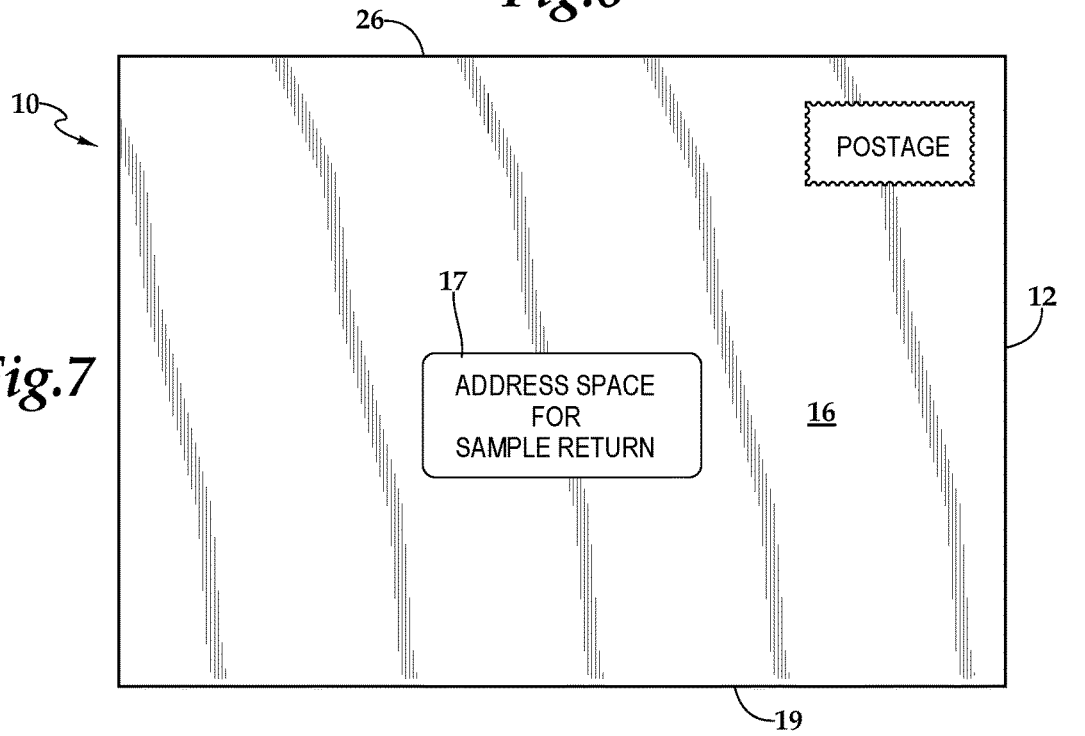
FIG. 7 is a front elevation view similar to that which is shown in FIG. 4, but with the envelope shown with a top flap closed down to seal the envelope, as it would appear when a bulky item has been sealed therein for return delivery, such as to a medical laboratory or other processing center if the bulky item is a medical sample return vial.
Figure 8:
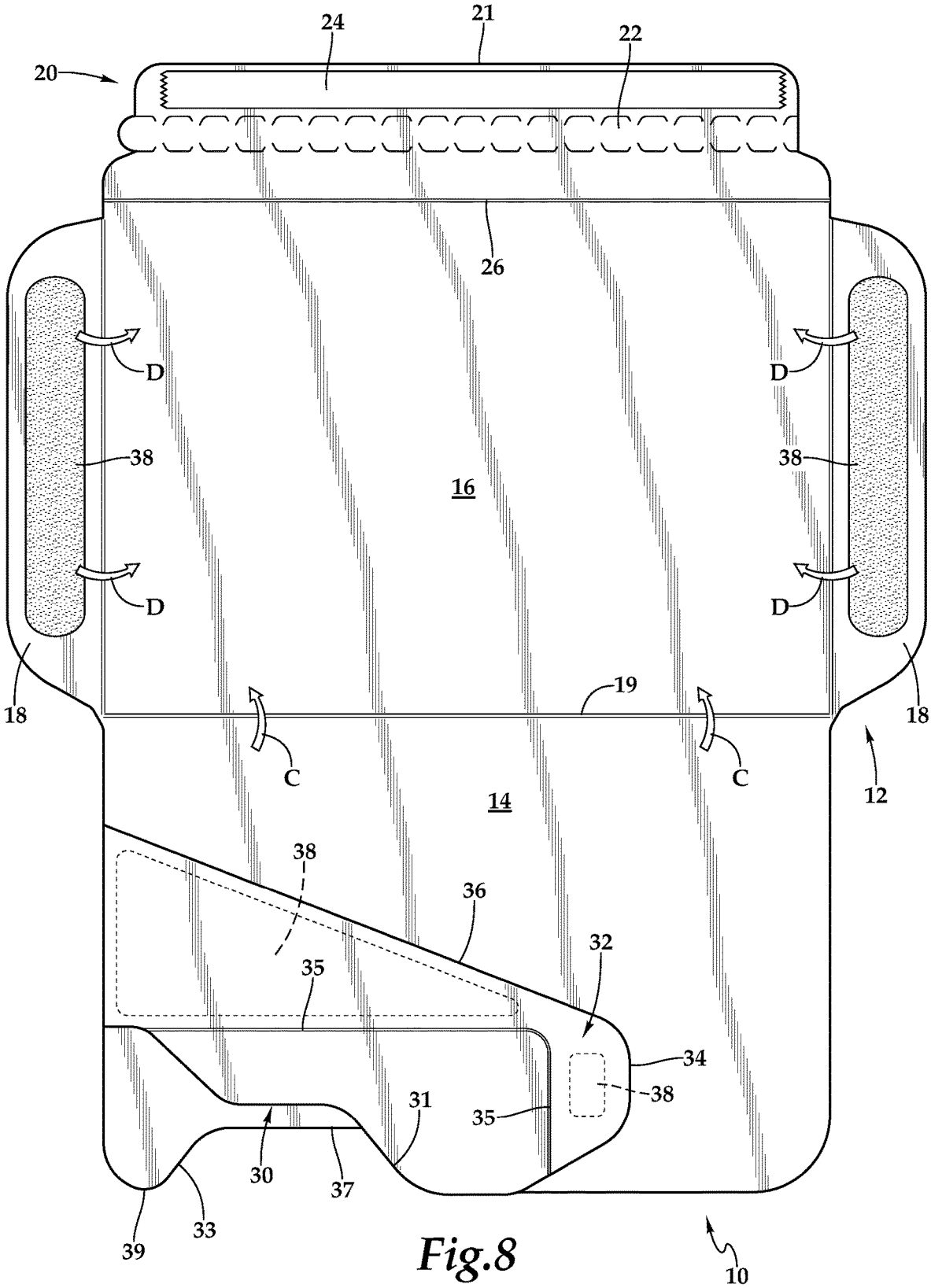
FIG. 8 is a rear elevation view of the envelope of FIG. 1 shown partially deconstructed into a planar sheet, but with the pocket thereof constructed by bonding of an interior flap adjacent to a rear panel of the envelope. Regions of the envelope which contain an adhesive for bonding of portions of the envelope together are depicted in solid lines where the adhesive region is visible, and in broken lines where the adhesive region is hidden.
Figure 9:
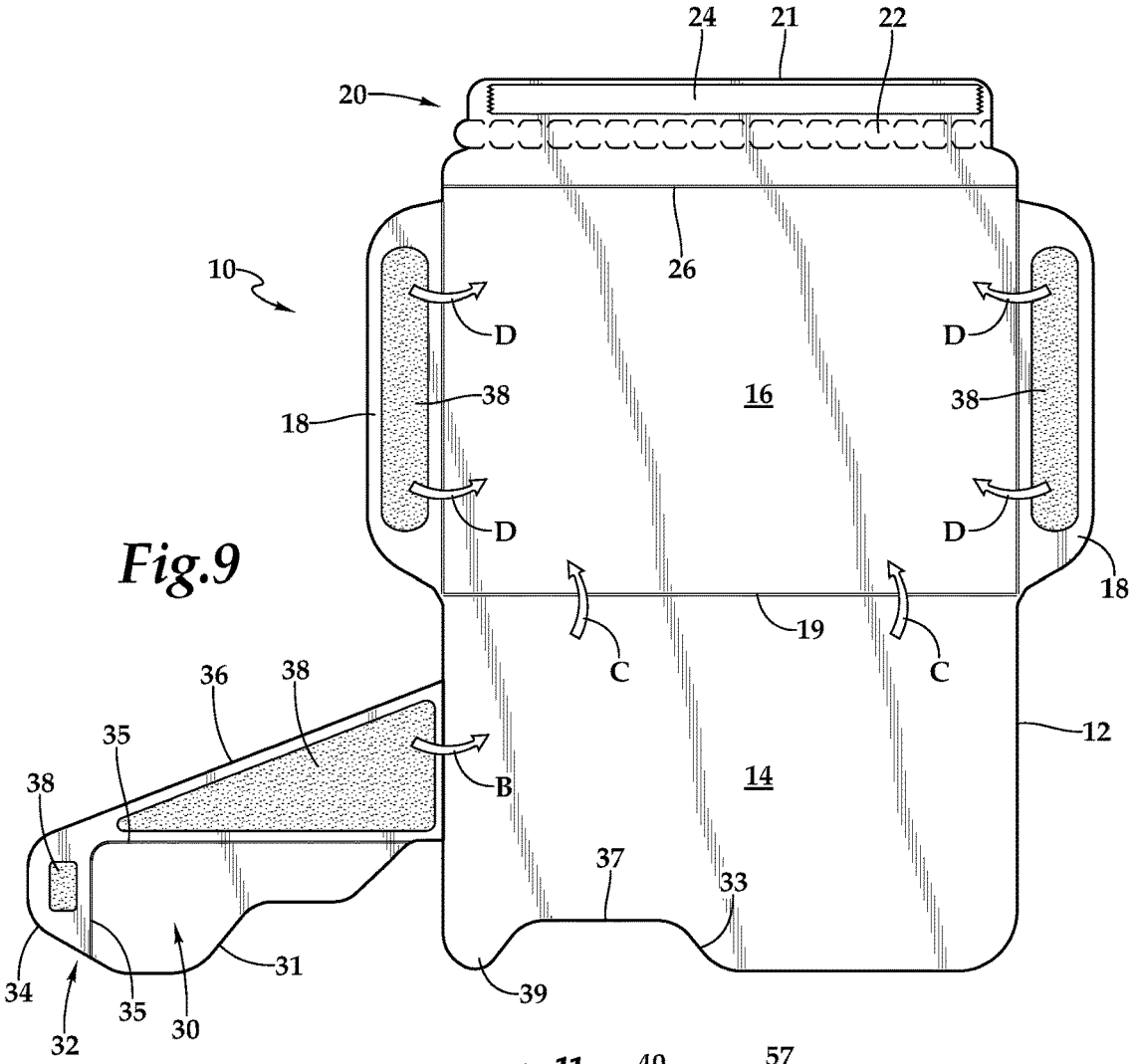
FIG. 9 is a rear elevation view similar to that which is shown in FIG. 8, except with the interior flap also deconstructed into a planar sheet with other portions of the envelope.

In essence, and with particular reference to FIGS. 1-4, basic details of the return envelope 10 are described according to an example embodiment. Return envelope 10 is constructed by folding an original planar sheet of suitable planar flexible material (FIG. 9) so that it creates a pocket 30 therein. The return envelope includes a body 12 having an interior 15 therein for containing items have a generally planar nature, and also including the pocket 30 which can contain an at least moderately bulky item, such as a medical sample return vial or other sample container 40 therein. A top flap 20 extends up from the body 12 and is selectively closable to configure the return envelope 10 (as shown in FIG. 7) to pass through the mail or other delivery process. One initial planar configuration for the envelope before it is folded and adhesively bonded strategically to itself to form the final return envelope 10, is depicted in FIGS. 8 and 9. An outer envelope 50 (FIG. 10) has an automated handling region 60 on lower portions thereof. The outer envelope 50 can contain the return envelope 10 with the sample container 40 within the pocket 30 of the return envelope 10, to keep the sample container 40 or other at least moderately bulky item above the automated handling region 60 of the outer envelope 50. Such positioning facilitates automated handling of the outer envelope 50 during a mailing or other delivery process.

More specifically, and with continuing reference to FIGS. 1-4 as well as FIGS. 8 and 9, details of the return envelope 10 and its associated pocket 30 are described according to this example embodiment. The return envelope 10 is in this embodiment part of a multi-envelope assembly, where the return envelope 10 is an inner envelope of the assembly and an outer envelope 50 is also provided in which the return envelope 10 is contained. The return envelope 10 could alternatively be used alone or in conjunction with other envelopes, in which case it might not be utilized for "return" of anything, so that identification of the envelope 10 as a "return" envelope may not be consistent with all embodiments of this invention. The return envelope 10 in this example embodiment is constructed to be in an open configuration (FIG. 1) and is located within the outer envelope 50, which is depicted sealed up and with the return envelope 10 therein in FIGS. 10 and 11.

The return envelope 10 includes a body 12 and a top flap 20. Top flap 20 allows for selective closing and opening of the return envelope 10 relative to the body 12. The body 12 in this example embodiment is constructed of a rear panel 14 and a front panel 16 on either side of an interior 15. The panels 14, 16 are preferably formed from a common sheet of material (FIGS. 8 and 9). In one embodiment, this material is a heavy card stock type material which is flexible when bending loads are applied, but which generally remains planar when no loads other than gravity loads are acting thereon, even when oriented horizontally in a large sheet (such as 8½"×11"). This material also typically includes an at least somewhat waterproof coating on an exterior thereof (and optionally also an interior), or a waterproof character built into the material itself. In this way, passage of liquids into or out of the return envelope 10 is to some extent resisted and strength of the return envelope 10 can be maintained, should contact with liquids occur.

The body 12 extends down to the bottom crease 19 defining a lowermost portion and bottom edge of the return envelope 10. The bottom crease 19 facilitates establishing a lower edge where the front panel 16 and rear panel 14 come together (after pivoting about the bottom crease 19 along arrow C of FIGS. 8 and 9). Side flaps 18 are joined preferably through vertical creases to the front panel 16. Adhesive areas 38 are provided in one embodiment to allow the side flaps 18 to be bonded to the rear panel 14 (after pivoting about arrow D of FIGS. 8 and 9) and so that the body 12 can completely surround the interior 15 of the body 12, other than at an upper portion of the interior 15 (when the top flap 20 is in an open orientation).

An address space 17 defines a portion of an outer surface of the front panel 16. A postage space can also be provided on this outer surface of the front panel 16. Generally, this address space 17 is in a middle of the outer surface of the front panel 16, the middle being defined as a region which is spaced away from all edges of this outer surface. In some embodiments, the address space is confined to a lower half of this outer surface or to others specific areas, such as having a specific distance (or distance range) away from a lower edge, defined by the bottom crease 19.

The top flap 20 extends up from a portion of the front panel 16 defined by a crease 26 opposite the bottom crease 19 (FIG. 7). This crease 26 is in one embodiment formed by embossing and is linear and horizontal in form. The crease 26 is sufficiently deep and wide that it facilitates bending of the top flap 20 180° for closing of access into the interior 15 of the body 12 of the return envelope 10. The top flap 20 terminates at an upper edge 21 opposite the crease 26. In one embodiment, this top flap 20 is about one inch in height from the crease 26 to the upper edge 21, and the top flap 20 is of a width similar to a width of the front panel 16 and of the entire return envelope 10.

The top flap 20 can be held closed by an adhesive. In one embodiment, an adhesive is pre-applied to the top flap 20 and covered by a protective backing strip 24. The backing strip 24 can be removed to expose this adhesive, and then the top flap 20 can be folded to a closed orientation and the adhesive under the removed backing strip 24 used to keep the return envelope 10 sealed closed. A tear panel 22 is shown in this embodiment between the adhesive strip 24 and the crease 26. The tear panel 22 is configured with a tip that can be gripped and pulled laterally, in a tearing motion, to cause the top flap 20 to tear open, and so that contents within the interior 15 of the body 12 can be accessed, such as by a recipient of the return envelope 10. In one embodiment, this tear panel 22 is formed by cutting a series of slots extending linearly horizontally, generally parallel with each other along a width of the top flap 20 and in line with the pull tab. A strengthening layer can be added to the tear panel 22 if warranted, to keep the tear panel together as it is pulled for opening of the return envelope 10. As an alternative, perforations or other zones of weakness could be provided adjacent edges of this tear panel 22, sufficient to facilitate tearing open of the top flap 20 and accessing of the interior 15 of the return envelope 10.

With continuing reference to FIGS. 1-4, as well as FIGS. 8 and 9, details of the pocket 30 of the return envelope 10 are described, according to this example embodiment. The pocket 30 defines one form of containment area within the return envelope 10 for keeping an at least somewhat bulky item spaced away from lower portions of the return envelope 10 and/or the outer envelope 50 containing the return envelope 10. An item is considered to be at least somewhat bulky if it is thicker than the body 12 of the return envelope 10 itself, and/or if it is thicker than the other contents of the return envelope 10, such that the at least somewhat bulky item defines a thickest portion of contents within the interior 15 of the return envelope 10.

In this embodiment, the pocket 30 defines a space between the rear panel 14 and an interior flap 32 bonded to the rear panel 14 below the pocket 30. In one embodiment, the interior flap 32 is also joined to a lateral edge of the rear panel 14 through a lateral crease line extending vertically, and which can be defined by embossing a linear groove at this crease line. The interior flap 32 can then rotate 180° (along arrow B of FIG. 9) to be adjacent to an inner surface of the rear panel 14 (as depicted in FIG. 8 and FIG. 1 in broken lines).

An upper rim of this pocket 30 is defined by an inner edge 31 and an outer edge 33. The inner edge 31 is defined by upper portions of the interior flap 32. The outer edge 33 is defined by upper portions of the rear panel 14. The pocket 30 thus defines a portion of the interior 15 of the return envelope 10. Other portions of this interior 15 can support planar items such as instruction sheets, thin cushioning padding, watertight sleeves, labels and various other contents, such as contents which would be provided when utilizing the return envelope 10 as at least part of a medical sample return kit.

Interior flap 32 is configured in this embodiment to extend from the lateral crease line to a tip 34 most distant from the lateral crease line and generally slightly past a midpoint in a width of the rear panel 14. A gusset 36 defines a portion of the interior flap 32 below the pocket 30. Adhesive areas 38 are provided on the tip 34 and gusset 36 to allow for bonding of the interior flap 32 to the rear panel 14, while leaving the pocket 30 open from above for insertion of a sample container 40 or other at least some of bulky item therein (along arrow E of FIG. 1).

A crease line 35 is preferably provided on the interior flap 32 and with a horizontal extending portion and a vertical extending portion generally outlining a perimeter of the pocket 30. This perimeter of the pocket 30 is preferably wider (horizontally) than it is tall (vertically). Dimensions for the pocket 30 can be provided slightly larger than a sample container 42 allowing for the sample container 40 to fit into the pocket 30 (from above along arrow E of FIG. 1) for selective insertion and removal of the sample container 40 into and out of the pocket 30.

To facilitate gripping of a sample container 40 (such as by a hand of a user when the sample container 40 is within the pocket 30), the interior flap 32 at the inner edge 31 preferably includes a terraced form with a series of horizontal steps spaced from each other by diagonal slopes as the inner edge extends laterally from near a center of the return envelope 10 to near a lateral edge of the return envelope 10. The rear panel at the outer edge 33 includes a notch 37. The notch 37 defines portions of the rear panel and outer edge which are lower than other portions of the outer edge 33, and including a knob 39 where this outer edge 33 is adjacent to a lateral edge of the return envelope 10 and bonded to one of the side flaps 18 of the body 12.

The material forming the rear panel 14 and interior flap 32 is sufficiently flexible that a sample container 40 can be wedged therein and is generally held therein. In one example, the pocket has dimensions of about one inch deep vertically (from uppermost portion of the inner edge 31 and outer edge 33) and about four inches long horizontally. A sample container 40 having dimensions of about two inches long horizontally and a half inch tall and between an eighth of an inch and a quarter inch in thickness can fit within this pocket 30. The material of the body 12 adjacent to the pocket 30 is sufficiently stiff that sample container 40 is wedged and held securely when so inserted from above (along arrow E) into the pocket 30.

In one embodiment, the sample container 40 includes a removable cap 42 attachable to a vial 44 with a hollow interior in which a medical sample can be located. Other forms of sample containers 40 or other at least somewhat bulky items could alternatively be placed within the pocket 30.

Figure 11:
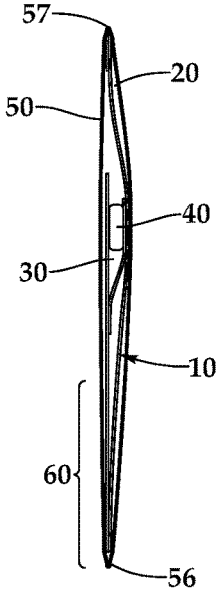
FIG. 11 is a full sectional side elevation view of that which is shown in FIG. 10.
Figure 10:
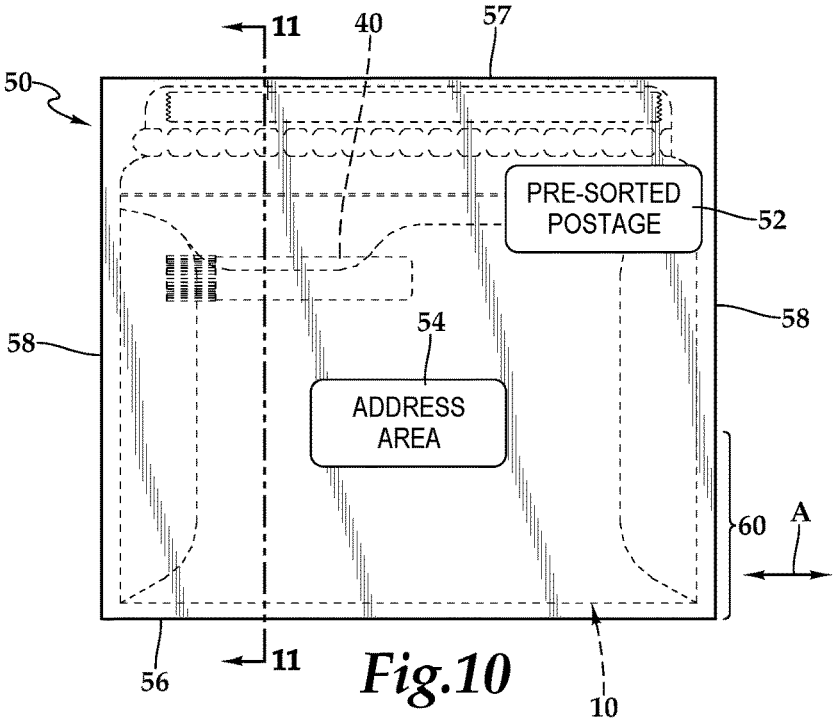
FIG. 10 is a front elevation view of an outer envelope containing an inner envelope configured according to FIGS. 1-6 therein, and with a bulky item contained within a pocket of the inner envelope. The inner envelope and bulky item are shown in broken lines, depicting one example of relative size between the inner envelope and outer envelope, and one example of position of the inner envelope and bulky item within the outer envelope, and how the multi-envelope assembly keeps the bulky item above an automated handling region on a lower portion of the outer envelope.

With particular reference to FIGS. 10 and 11, details of an outer envelope 50 multi-envelope assembly are described, according to one embodiment of this invention. The outer envelope 50 can have a general shape similar to that of the return envelope 10, but large enough to contain return envelope 10 therein, and most preferably with the return envelope 10 not yet having had its top flap 20 closed. In at least some embodiments, the outer envelope. 50 is formed of a lighter weight, flexible, planar material then that for the return envelope 10. Details of the outer envelope 50 which are similar to the return envelope 10 are otherwise similar to mailing envelopes generally, and so are not redundantly described herein. These details generally include front and rear panels joined together at perimeter edges, and with some form of flap or other access which is closable to contain items within an interior thereof.

Importantly, the outer envelope 50 includes a lower edge 56 opposite a top edge 57. An automated handling region 60 is located adjacent to this lower edge 56 and extending somewhat up from the lower edge 56, and generally between two opposite lateral side edges 58. A front of the outer envelope 50 includes a postage space 52, generally at an upper right corner of a front of the outer envelope 50 and an address area 54.

The automated handling region 60 defines some portion of the outer envelope 50 extending up from lower edge 56 which is handled by automated envelope processing equipment. Such handling can include holding, squeezing, weighing, transporting, routing and other manipulation of the envelope during mail sorting and processing, especially with automated equipment and especially with movement horizontally (along arrow A of FIG. 10). Depending on the characteristics of this machinery, this automated handling region extends up from the lower edge 56 to an extent required to be able to come into contact with such equipment without becoming jammed or otherwise mishandled by such equipment. In one embodiment, this automated handling region 60 extends four inches up from the lower edge 56 of the outer envelope 50.

Generally, it is desirable for the outer envelope 50 and any contents therein to remain sufficiently thin that the automated envelope handling equipment has its tolerance for envelope thickness not exceeded. While in the prior art a simple method for maintaining sufficient envelope handling involves merely keeping a maximum thickness of the outer envelope 50 and its contents below this maximum thickness tolerance amount of such equipment, this can preclude the thickness associated with moderately bulky items, such as the sample container 40.

By keeping the sample container 40 above the automated handling region 60, the outer envelope 50 and its contents can be thicker than a maximum thickness tolerance for envelope handling equipment, and avoid mishandling because the automated handling region 60 of the outer envelope 50 is maintained below this tolerance thickness for such machinery. This is done by keeping the pocket 30 and the sample container 40 therein above the automated handling region 60 of the outer envelope 50. Similarly, and if desired, the return envelope 10 can have an automated handling region 60 defined by lower portions of the return envelope 10 and the pocket 30 of the return envelope 10 can similarly be spaced above such an automated handling region. This allows for processing of the return envelope 10 and a sample container 40 therein separate from the outer envelope 50, such as during a return shipping process for the sample container 40.

The outer envelope 50 includes the return envelope 10 therein. The return envelope 10 is sufficiently large to allow it to fit within the outer envelope 50 but not be able to rotate within the outer envelope 50 (or to at least resist such rotation). Thus, with the return envelope 10 maintaining its upright orientation within the outer envelope 50, and with the pocket 30 located within the return envelope 10, strategically above lower portions of the return envelope 10, the pocket 30 and sample container 40 therein are kept above the automated handling region 60 on the outer envelope 50. The resulting compliant multi-envelope assembly is thus appropriate for use with automated mail handling equipment, while at least somewhat bulky items (such as sample containers 40) can also be contained within such a multi-envelope assembly. Similarly, a single envelope such as the return envelope 10 can have an at least somewhat bulky item (such as the sample container 40) kept out of a lower portion of such a single envelope. This thin lower portion provides an automated handling region thereof for automated handling of such a single envelope, with such a pocket 30 and associated sample container 40 therein.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When embodiments are referred to as "exemplary" or "preferred" this term is meant to indicate one example of the invention, and does not exclude other possible embodiments. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. A mailing envelope, comprising in combination:

a front panel of a planar and flexible form;

a rear panel of a planar and flexible form;

an interior space between said front panel and said rear panel;

a pocket comprising only a portion of said interior space;

at least one edge joining said front panel to said rear panel;

said pocket spaced from said at least one edge;

wherein said at least one edge defines a lower portion of an automated handling region of the envelope, said pocket spaced from said edge by a distance at least as great as a height of said automated handling region, such that any bulkiness associated with an item located within said pocket is located above said automated handling region of the envelope;

wherein said pocket is attached to only one of said front panel or said rear panel, with said pocket accessible from a side of said pocket opposite said at least one edge;

wherein said pocket is attached to said rear panel of the envelope, said pocket including an interior flap extending from a lateral edge of the envelope;

wherein said interior flap is bonded with an adhesive to said rear panel below said pocket and on a lateral side of said pocket opposite said lateral edge of the envelope from which said interior flap extends; and wherein said interior flap includes a crease line defining at least portions of a lower boundary of said pocket.

2. The envelope of claim 1 wherein said pocket is spaced from a middle portion of said interior space midway between an upper portion and a lower portion of said interior space, such that a bulky item located within said pocket causes the envelope to bulge at a location spaced from said middle portion.

3. The envelope of claim 1 wherein said pocket defines a thickest portion of said interior space between said front panel and said rear panel.

4. The envelope of claim 1 wherein said at least one edge defines a portion of the envelope opposite an uppermost portion of the envelope, said uppermost portion of the envelope configured to be selectively openable and closable.

5. The envelope of claim 4 wherein said pocket is closer to said uppermost portion of the envelope than to said lower portion of the envelope.

6. The envelope of claim 1 wherein upper portions of said pocket include an inner edge opposite an outer edge, said inner edge closer to said front panel then said outer edge, said outer edge defining an uppermost portion of said rear panel.

7. The envelope of claim 6 wherein said outer edge of said pocket includes a notch where said outer edge is closer to a bottom of said pocket than portions of said outer edge lateral to said notch.

8. The envelope of claim 7 wherein said front panel includes a top flap, said top flap including a crease, a tear panel and an adhesive space covered by a backing strip, said top flap configured to pivot about said crease to selectively close said envelope.

* * * * *